US007670201B2

(12) United States Patent
Winter

(10) Patent No.: US 7,670,201 B2
(45) Date of Patent: Mar. 2, 2010

(54) ADJUSTABLE RIGGING SYSTEM FOR A ROWING BOAT

(76) Inventor: Jonathan Winter, 44 Highland St., New Haven, CT (US) 06511

( * ) Notice: Subject to any disclaimer, the term of this patent is extended or adjusted under 35 U.S.C. 154(b) by 86 days.

(21) Appl. No.: 12/038,853

(22) Filed: Feb. 28, 2008

(65) Prior Publication Data

US 2008/0214071 A1 Sep. 4, 2008

Related U.S. Application Data

(60) Provisional application No. 60/892,368, filed on Mar. 1, 2007.

(51) Int. Cl.

| | |
|---|---|
| ***B63H 16/00*** | (2006.01) |
| *B63H 16/04* | (2006.01) |
| *B63H 16/10* | (2006.01) |
| *B63B 17/00* | (2006.01) |

(52) U.S. Cl. ..... 440/109; 440/106; 440/105; 440/104; 440/101; 114/343; 114/364

(58) Field of Classification Search ..... 440/101–110; 114/343, 364

See application file for complete search history.

(56) References Cited

U.S. PATENT DOCUMENTS

| | | | | |
|---|---|---|---|---|
| 3,708,141 | A * | 1/1973 | Friedgen et al. | 248/515 |
| 3,898,950 | A * | 8/1975 | Martin | 440/105 |
| 4,352,667 | A | 10/1982 | Neville | 440/105 |
| 5,873,757 | A | 2/1999 | Van Balen | 440/105 |
| 6,183,325 | B1 | 2/2001 | Purser | 440/106 |

FOREIGN PATENT DOCUMENTS

| | | |
|---|---|---|
| WO | 91/08945 | 6/1991 |

* cited by examiner

*Primary Examiner*—Daniel V Venne
(74) *Attorney, Agent, or Firm*—St. Onge Steward Johnston & Reens LLC

(57) ABSTRACT

An adjustable rigging system for a boat including a bracket adapted to connect to an outboard end portion of a stay mechanism for a boat, the bracket including a top hole and a bottom hole, wherein an axis is defined between a center of the top hole and a center of the bottom hole, a pin extending along the axis including two ends, each end removably connected to the bracket adjacent to one of the top and bottom holes, and wherein the location of at least one of the top and the bottom holes is adjustable to change a pitch of the axis and the pin.

20 Claims, 17 Drawing Sheets

ADJUSTABLE RIGGING SYSTEM FOR A ROWING BOAT

CROSS-REFERENCE TO RELATED APPLICATIONS

This application claims priority benefits under 35 § U.S.C. 119(e) of the U.S. Provisional Application No. 60/892,368, filed on Mar. 1, 2007.

FIELD OF THE INVENTION

The invention relates to a rigging system for a rowing boat, and more specifically to a rigging system with means to adjust the pitch of pin in one or multiple directions.

BACKGROUND OF THE INVENTION

In the sport of rowing, there are rigid members attached to the side of a hull to hold a cylindrical pin at the appropriate distance from the boat. These are called riggers. An oar lock holds an oar and rotates around a pin. The main object of a rigger is to support the force generated by the user. An important feature in a rigger is its adjustability. Adjustability is important so that the rigging measurements may be customized to the user for optimal performance. One of the measurements many users desire to change is pitch. Pitch can be measured in two common ways, stern and lateral pitch. Stern pitch is the angle of the pin relative to the lengthwise axis of the boat. Lateral pitch is measured relative to the axis perpendicular to the lengthwise axis.

There are many classes and types of riggers that generally fall into two categories. The first class is fixed pitch riggers. These riggers have a pin bolted into a slot, with a fixed pitch. The pitch on the pin with these riggers is usually made to be zero (0) degrees both stern and lateral, which causes the pin to be vertical. The pitch may be adjusted on these riggers. However, it is a very difficult process which involves carefully bending the pin to the desired angle. This process is also potentially damaging to the rigger and the boat as it relies on plastic deformation of the rigger.

The second class of riggers is those which support the pin from a single bracket member which attaches both to the top and bottom of the cylindrical pin.

Some of these riggers allow the adjustment of pitch, some do not. Most riggers allowing pin pitch to be adjusted use a bracket to support the pin from both the top and bottom. There are a wide range of shapes the bracket could potentially take, but all of these have in common two holes spaced apart to accommodate a pin. With this type of rigger allowing adjustable pitch, the bracket is usually in a semi circular or semi-spherical shape and the stern and lateral pitch may be adjusted by loosening a bolt. The stern pitch is adjusted by sliding the bolt along a slot in the bracket to change the stern pitch angle. Lateral pitch is adjusted by rotating the bracket about the bolt. This is made possible by the spherical shape of the bracket at the point where the bracket meets the rigid members extending from the boat. The bolt is tightened once the desired pitch is found. One problem with this system is that over time, the bracket will slide and the pitch angle will change. Additionally, when re-tightening the bolt to secure the pitch, the bracket usually moves with the torque generated by the rotation of the bolt. The other problem is that adjustment of this rigger requires a relatively high amount of skill, and ultimately is a waste of time for an athlete or coach.

Others of this second class of riggers do not allow any adjustment of pitch through simple methods as the bracket is attached to the rigger at a fixed pitch. One of the methods used for adjusting lateral pitch on these riggers involves bending the rigger so that it deforms and is at the desired pitch. In many cases, it is desired that the pitch be adjustable, and few are willing to bend the rigger on their boat for fear of causing permanent damage.

There are two basic mounting systems for riggers including side mount and wing mount. Side mount riggers mount to the side of the hull, and wing mount riggers mount to the gunwale. Further there are two disciplines in the sport of rowing, sweep rowing uses one oar per seat, sculling uses two oars per seat. A sculling wing rigger is one piece holding two pins, one on each side of the boat. A sculling side mount system uses two individual riggers each with one pin mounting to opposite sides of the boat.

U.S. Pat. No. 6,183,325 to Purser discloses that some oarlocks are designed to incorporate bushings or inserts to adjust for pitch and pin diameter. The oarlock inserts cited here only adjust pitch relative to the pin, and not the actual pitch of the pin itself, thus making it impossible to use these inserts to adjust outboard pitch without changing stern pitch. This limitation further makes it impossible to both have the total oarlock pitch to change throughout the stroke cycle and to make the actual total change be adjustable and user selectable.

WO 91/08945 A1 to Carter et al. discloses a method of adjusting pitch that uses a cam system to adjust the oarlock face. Although the structure of this invention is different than the bushing system mentioned in the Purser patent, it is irrelevant for the same reason that the adjustment is not directed to the pin, it is directed to the oarlock. Thus a change in oarlock pitch will result in an equivalent change in both total outboard and total stern pitch. Thus, it is impossible with the Carter patent to both have total pitch change throughout the stroke cycle, and to adjust the total amount of change there is throughout the stroke cycle.

SUMMARY OF THE INVENTION

Accordingly, it is an object of the present invention to provide a rigging system and rigger that includes a means to adjust pitch of its pin.

These and other objectives are achieved by providing an adjustable rigging system for a boat, including a bracket adapted to connect to an outboard end portion of a stay mechanism for a boat, the bracket including a top hole and a bottom hole, wherein an axis is defined between a center of the top hole and a center of the bottom hole, a pin extending along the axis including two ends, each end removably connected to the bracket adjacent to one of the top and bottom holes, and wherein the location of at least one of the top and the bottom holes is adjustable to change a pitch of the axis and the pin.

In some embodiments, the system further includes at least one pitch adjuster removably connected to the bracket and including one of the top hole and the bottom hole. In some embodiments, the system further includes a top pitch adjuster removably connected to the bracket and including the top hole, and a bottom pitch adjuster removably connected to the bracket and including the bottom hole, wherein at least one of the top and bottom holes is off-center with respect to a center of the respective pitch adjuster.

Other objectives and advantages are achieved by providing an adjustable rigging system for a boat including a bracket adapted to connect to an outboard end portion of a stay mechanism for a boat, the bracket including a top support member and a bottom support member, each support member including a support hole, one or more pitch adjusters each including one of an off-center pitch hole and a centered pitch hole, wherein at least a first one of the pitch adjusters is at least partially inserted in one of the support holes, a pin removably connected between the top support member and the bottom support member, wherein centers of each of the support holes in the top support member and the bottom support member define a support axis, and wherein a center of the pitch hole of the first one of the pitch adjusters is along a pitch axis. In some embodiments, the pitch axis is adjustable with respect to the support axis according to a selection of the one or more pitch adjusters.

In some embodiments, the system further includes a second one of the pitch adjusters at least partially inserted in another one of the support holes, wherein a center of the pitch hole of the second one of the pitch adjusters is either offset from the support axis or along the support axis. The pitch hole in the first one of the pitch adjusters and the pitch hole in the second one of the pitch adjusters may also define the pitch axis, the pitch axis being different from the support axis.

In other embodiments, the system further includes a cavity around at least one of the top and bottom hole, wherein at least one of the pitch adjusters is inserted at least partially within the cavity, and wherein the cavity retains the pitch member and prevents the pitch member from passing through the at least one hole. In some embodiments, the at least one of the pitch adjusters includes a flange, wherein the flange is larger than the support holes and prevents the entire pitch adjuster from passing through the support hole.

Further provided is a rigging system for a boat, including a stay mechanism for spacing at least one pin at a pre-determined distance from the boat, the stay mechanism including one or more outboard end portions, at least a first and a second bracket, each the bracket including first and second rigid support members spaced apart from each other by a distance, the members each including a hole, the holes in the first bracket defining a first axis, the holes in the second bracket defining a second axis, the holes in the first and second brackets located so that the first axis is at a different angle than the second axis, wherein a selected one of the first and second brackets is releasably secured to at least one of the outboard end portions, and wherein a pin is secured to the selected bracket along the axis of the selected bracket. At least one of the first and second rigid members of the selected bracket may include a pitch adjuster, wherein the pitch adjuster includes the hole.

Other objects, features and advantages according to the present invention will become apparent from the following detailed description of certain advantageous embodiments when read in conjunction with the accompanying drawings in which the same components are identified by the same reference numerals.

DETAILED DESCRIPTION OF THE INVENTION

Figure 1A:
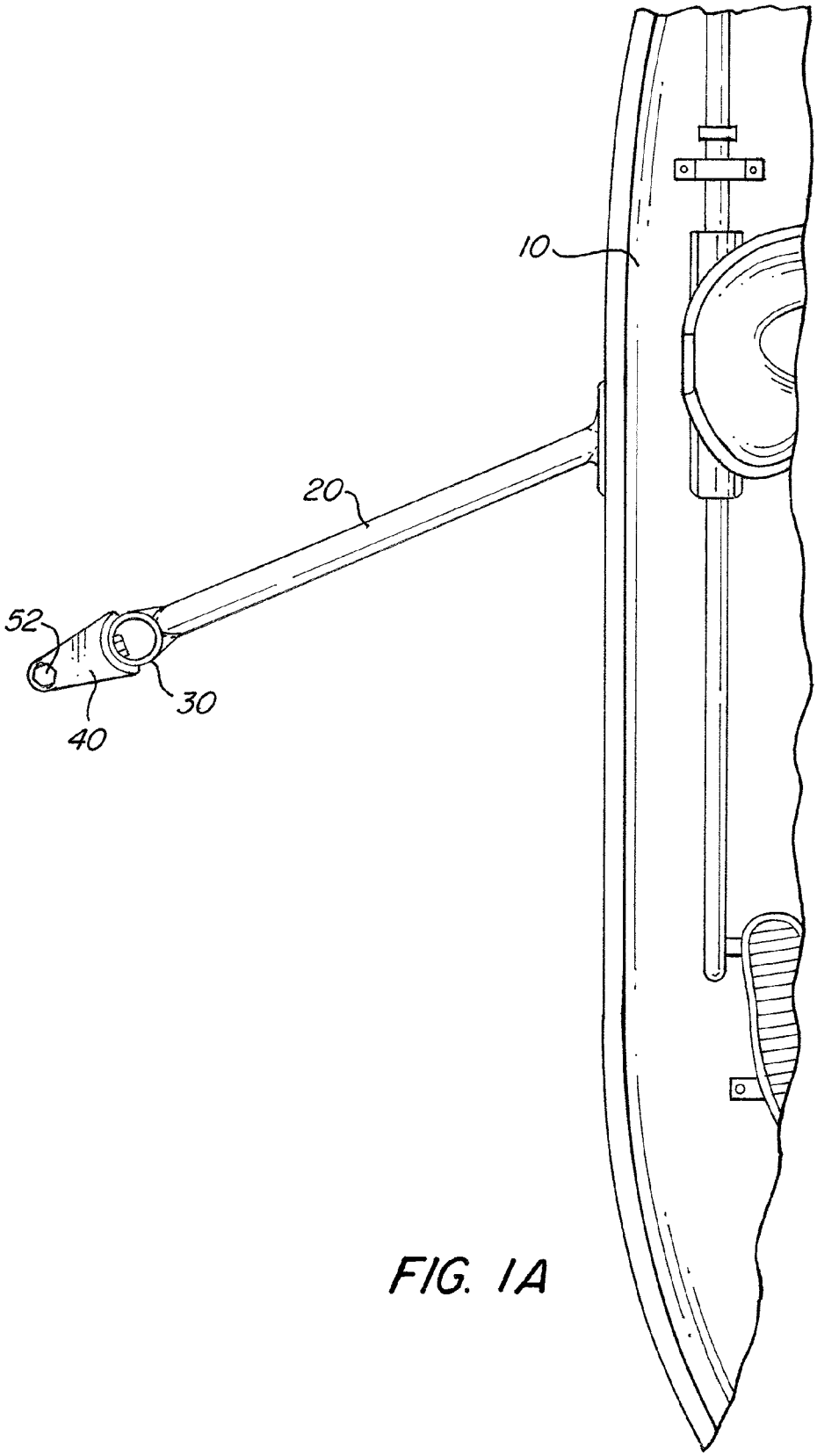
FIG. 1A is a top view of a rigger according to an exemplary embodiment of the present invention attached to a boat.
Figure 1B:
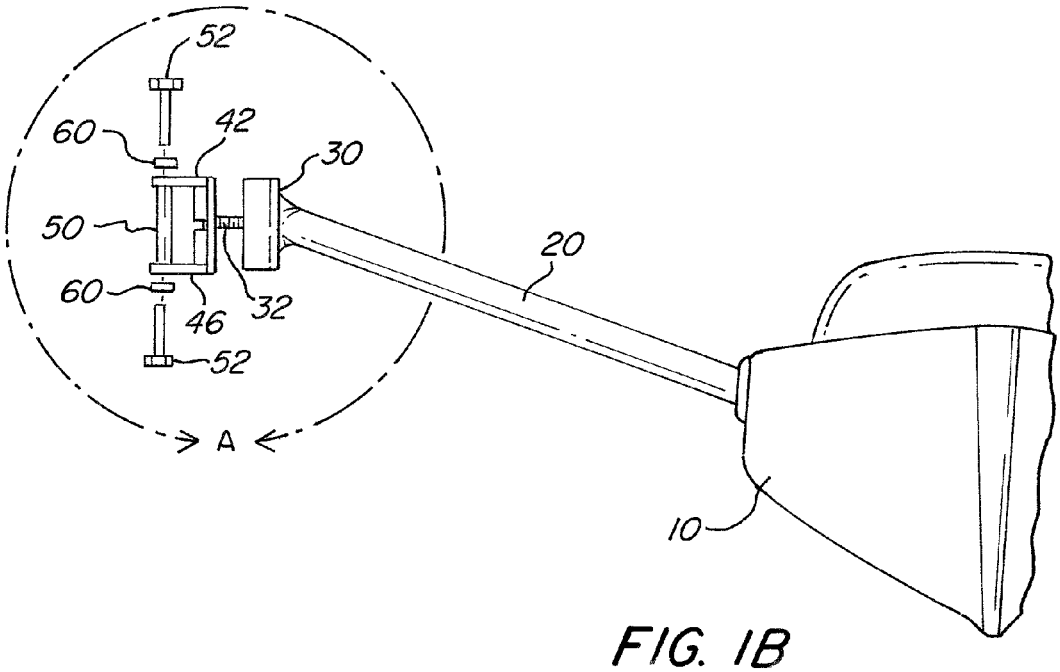
FIG. 1B is a front view of the rigger shown in FIG. 1A.
Figure 2:
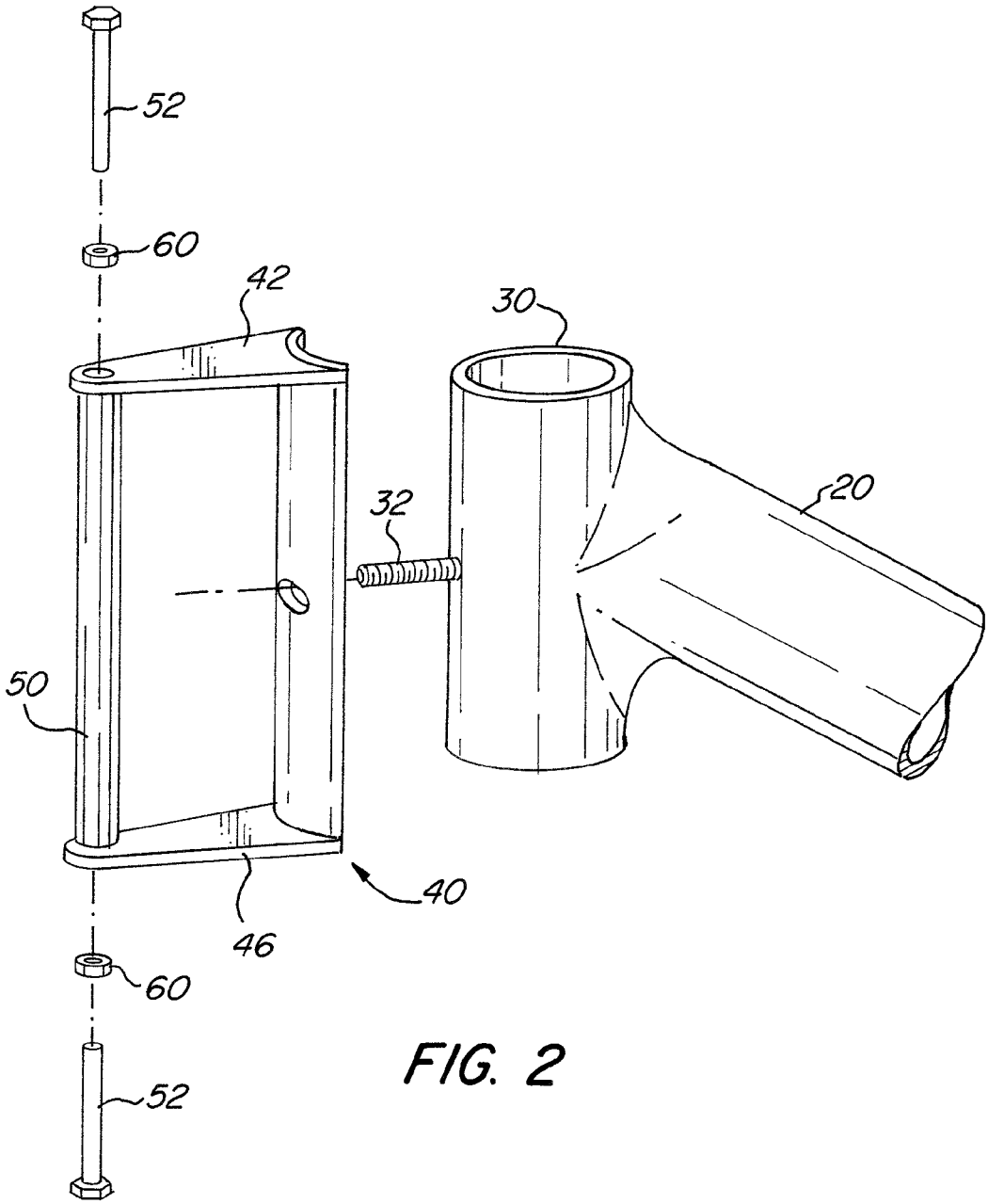
FIG. 2 is a detail view (A) of a portion of the rigger shown in FIGS. 1A and 1B.
Figure 3:
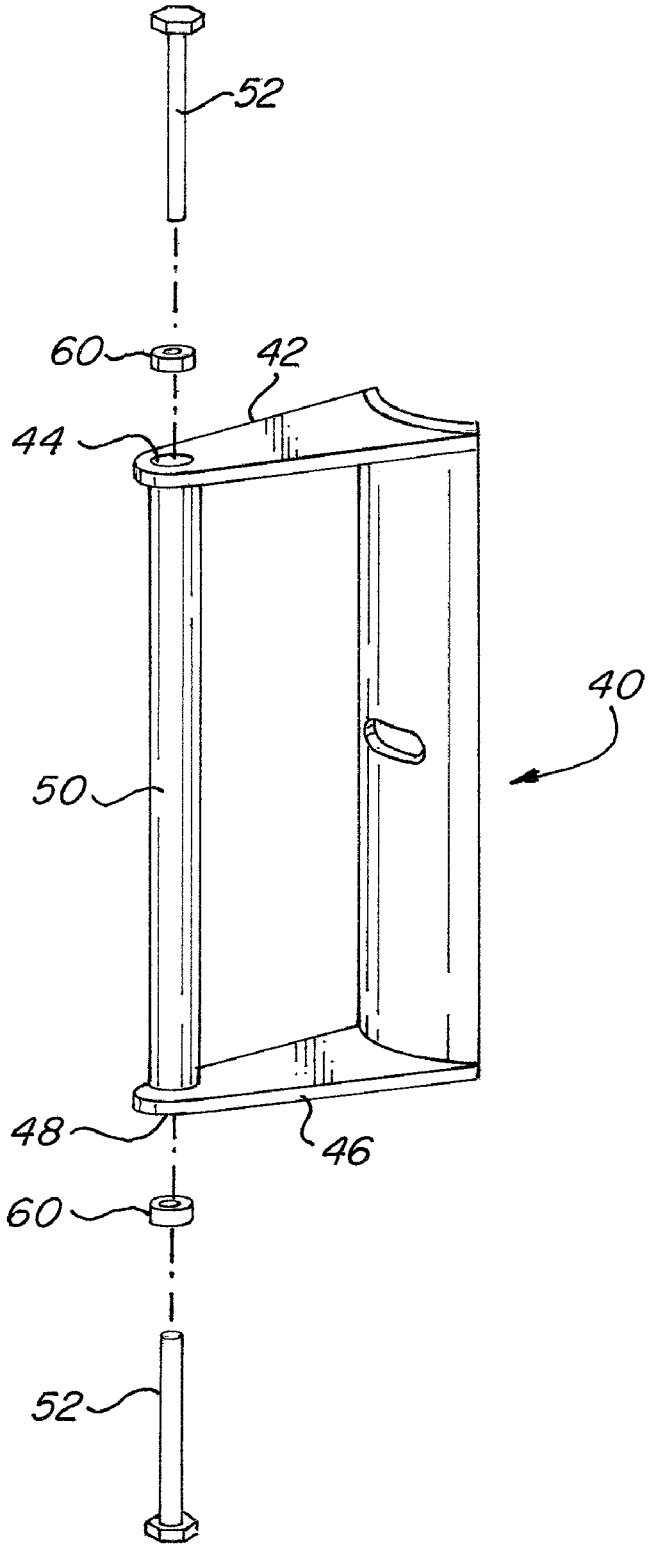
FIG. 3 is an isometric view of a bracket of the rigger shown in FIGS. 1A and 1B.

FIGS. 1A-3 illustrate a rigger or rigging system for a rowing boat 10 according to a first exemplary embodiment of the present invention. The rigging system includes a stay or stay mechanism 20 extending from the boat 10 to an outboard end portion 30. A bracket 40 including a top rigid support member 42 and a bottom rigid support member 46 is attached to the outboard end portion 30. The bracket 40 may be made in a variety of shapes capable of support a pin or other connection means from the top and bottom.

In the exemplary embodiment, the bracket 40 is secured to the outboard end portion 30 by a bolt 32. It should be noted however that the bracket 40 can be attached to the outboard portion 30 using a variety of methods. Some of the methods can be welding, adhesive, fasteners, bolts, contact geometry between the bracket 40 and the outboard end portion 30 (e.g., which prevents the bracket from rotating or sliding and thus changing the pitch), or a combination thereof. The important thing is that the bracket 30 is secured so that it does not move or slide.

The rigging system includes a pin 50 that is secured to the rigid support members 42/46 by one or more bolts 52. As one of ordinary skill in the art will understand, the pin 50 provides for the connection of an oarlock (not shown). Each of the support members 42/46 include a hole 44/48 (e.g., support hole), at least one of which is designed to accommodate a pitch adjustment mechanism or pitch adjuster 60. In the exemplary embodiment, the bolts 52 pass through the pitch adjusters 60 on the top and/or bottom portions of the bracket 40. The pitch adjusters 60 fit at least partially inside corresponding holes 44/48 in the rigid support members 42/46. In some other embodiments, the pitch adjuster 60 can attach directly to and/or against the bracket with a fastener system.

The bolts 52 pass through a hole 70 (e.g., pitch hole) in the pitch adjuster 60 and the holes 44/48 in the rigid support members 42/46 and thread into the pin 50. The geometry of the holes 44/48 in the rigid support member 42/46 could be many different shapes, but is preferably suitable to accommodate a range of locations for the hole 70 in the pitch adjuster 60.

Figure 4A:
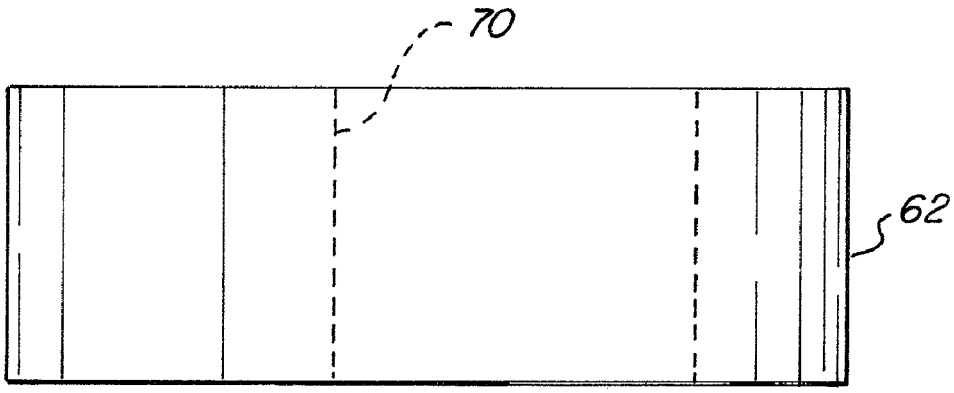
FIG. 4A is a side view of a pitch adjustment mechanism of the rigger shown in FIGS. 1A and 1B including an off-center hole.
Figure 4B:
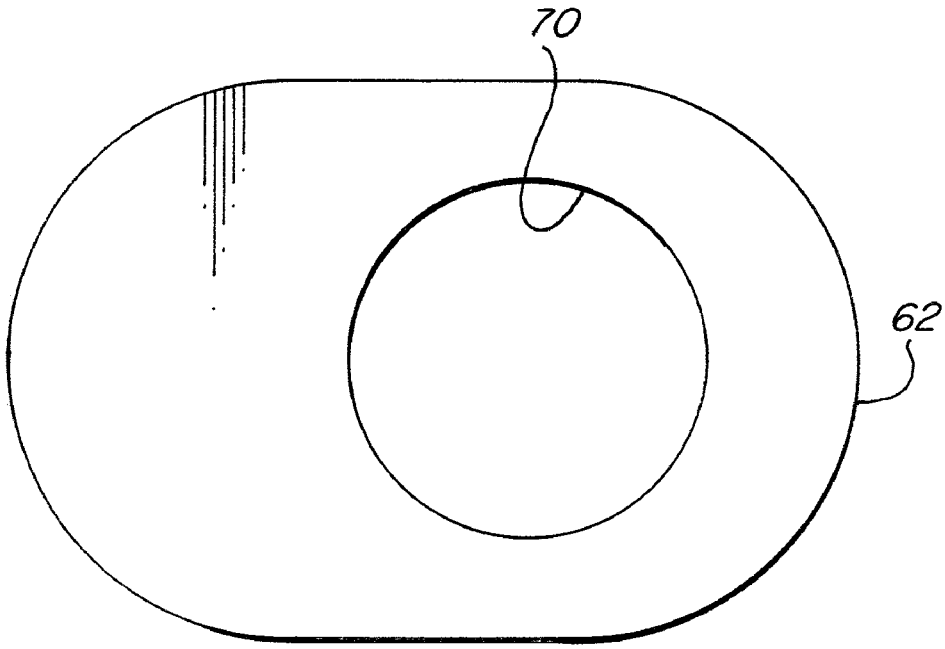
FIG. 4B is a top view of the pitch adjustment mechanism shown in FIG. 4A.
Figure 5A:
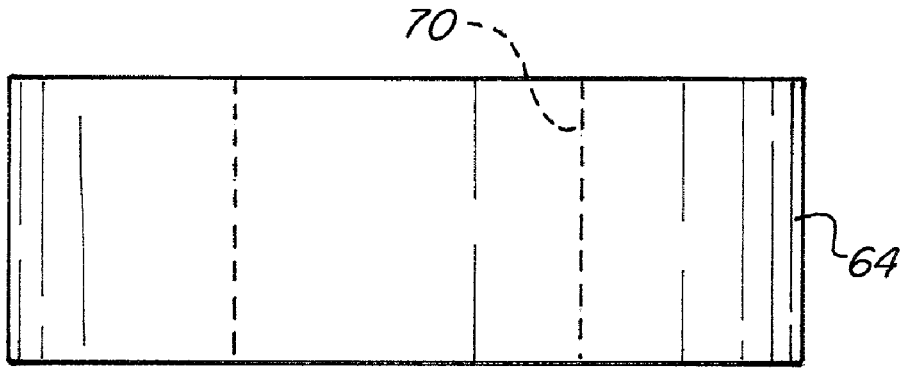
FIG. 5A is a side view of a pitch adjustment mechanism of the rigger shown in FIGS. 1A and 1B including a center hole.
Figure 5B:
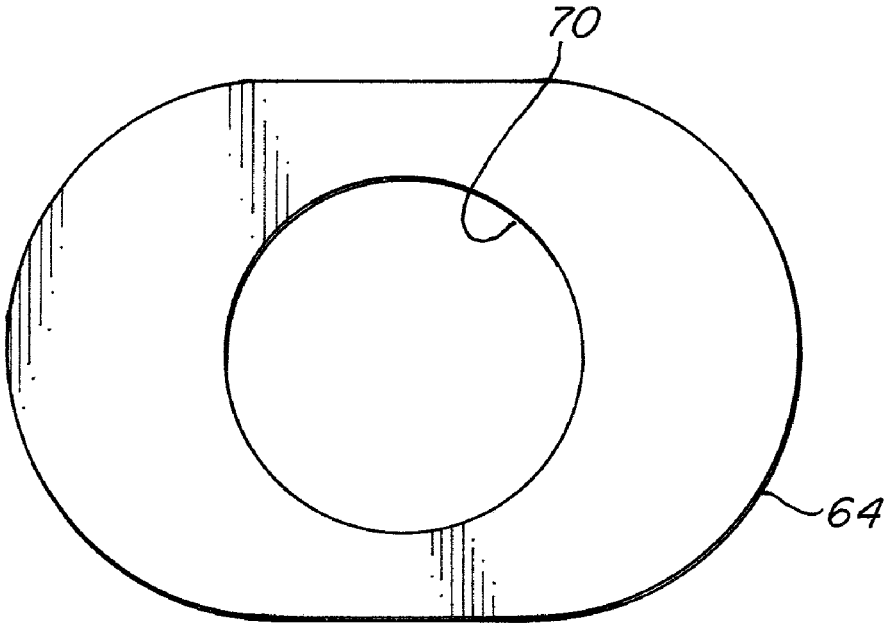
FIG. 5B is a top view of the pitch adjustment mechanism shown in FIG. 5A.

The pitch adjusters 60 may be off-center pitch adjusters 62 or centered pitch adjusters 64. FIGS. 4A and 4B illustrate an exemplary off-center pitch adjuster 62. FIGS. 5A-5B illustrate an exemplary centered pitch adjuster 64. The off-center pitch adjuster 62 is interchangeable with the centered pitch adjuster 64. The selection of different pitch adjusters 62/64 allows the user to adjust the pin axis and equivalently the pitch of the pin 50.

Figure 6A:
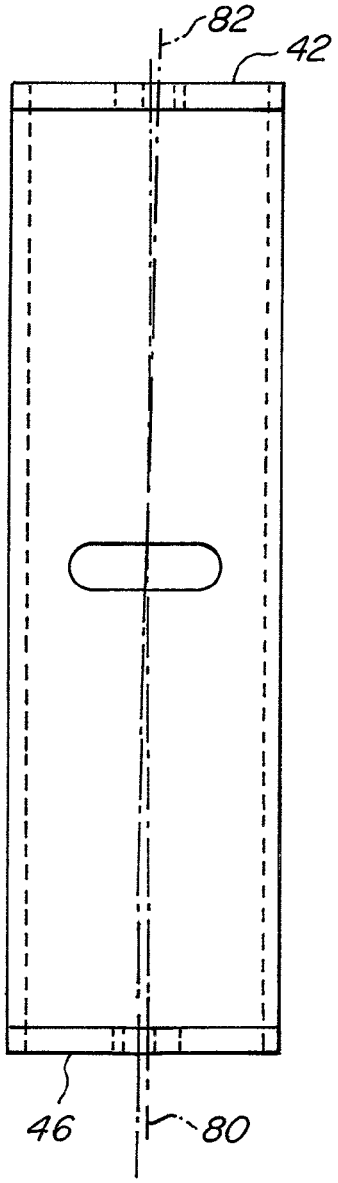
FIG. 6A is a side view of a bracket of a rigger according to an exemplary embodiment of the present invention including two pitch adjusters.
Figure 6B:
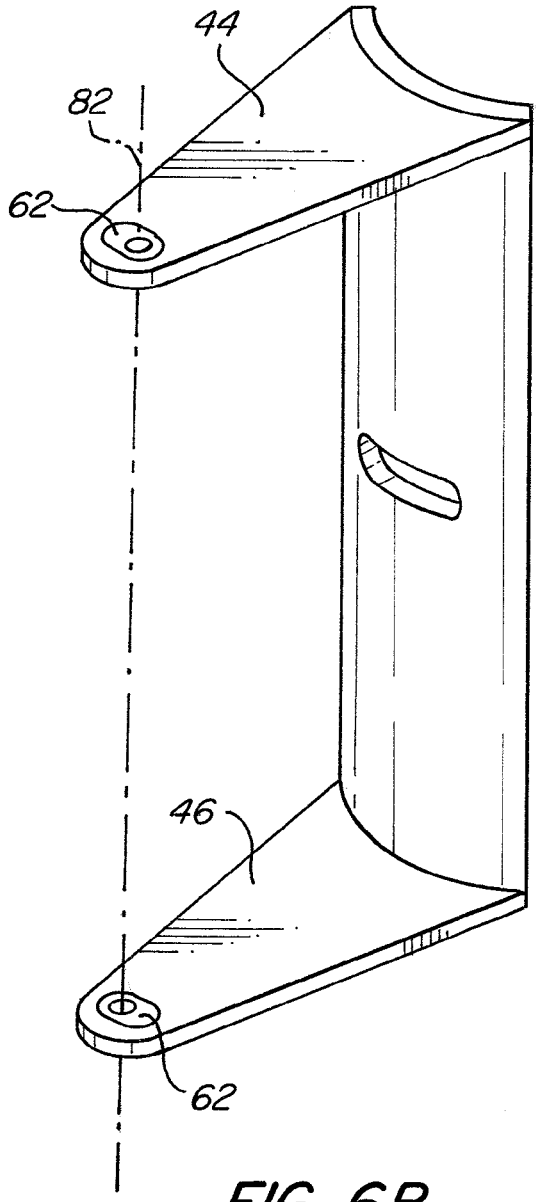
FIG. 6B is an isometric view of the bracket shown in FIG. 6A.

FIGS. 6A and 6B illustrate both the rigid support axis 80 and the pin axis 82. The rigid support axis 80 is defined as the line passing through the centers of the holes in the rigid support members 42/46. The pin axis 82 is defined as the line passing through the centers of the holes 70 in the pitch adjusters 60 (depending on which pitch adjuster 62/64 is selected). If a single pitch adjuster 60 is used, the pin axis is defined as the line passing through the center of the hole 70 in the pitch adjuster and the center of the hole in the opposing rigid support member. When one or more off-center pitch adjusters 62 are used on the bracket 40, the center of the hole 70 is offset from the rigid support axis 80 and the pin axis 82 is different from the rigid support axis 80.

The oarlock pitch is likewise changed with the pitch of the pin 50. A series of pitch adjusters may be used with centered holes or off-center holes to achieve a wide variety of possible pitches. Each hole 70 in the pitch adjuster 60 defines a different pin axis 82 with a measurable pitch when the pitch adjuster 60 is attached to both the bracket 40 and the pin 50. The pin axis 82 can be the same as the rigid support axis 80 if desired, but if a different pitch adjuster (e.g., 62) is selected, the pin axis 82 and the rigid support axis 80 may differ thus allowing pitch to be adjusted by selecting the desired pitch adjuster. The location of the pitch hole with respect to the center of the pitch adjuster 60 (e.g., both in the lateral and stern directions) may also vary between pitch adjusters 60 to allow for any number of pitch options. The present invention therefore allows a user to select how much if at all the total oarlock pitch changes throughout the stroke cycle as the oarlock rotates about the pin 50.

Figure 7:
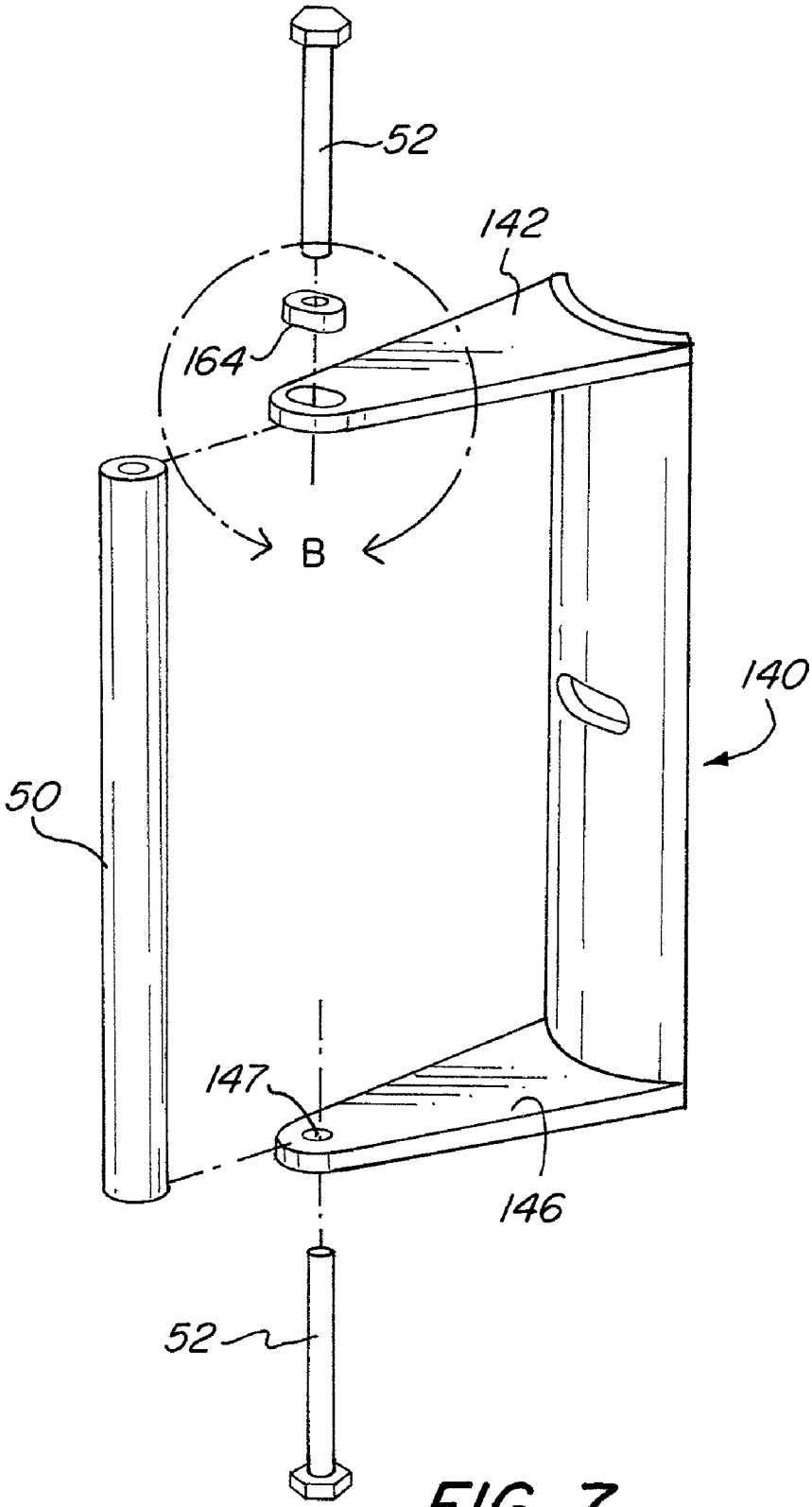
FIG. 7 is an exploded isometric view of a bracket of a rigger according to an exemplary embodiment of the present invention including a single pitch insert system.
Figure 8:
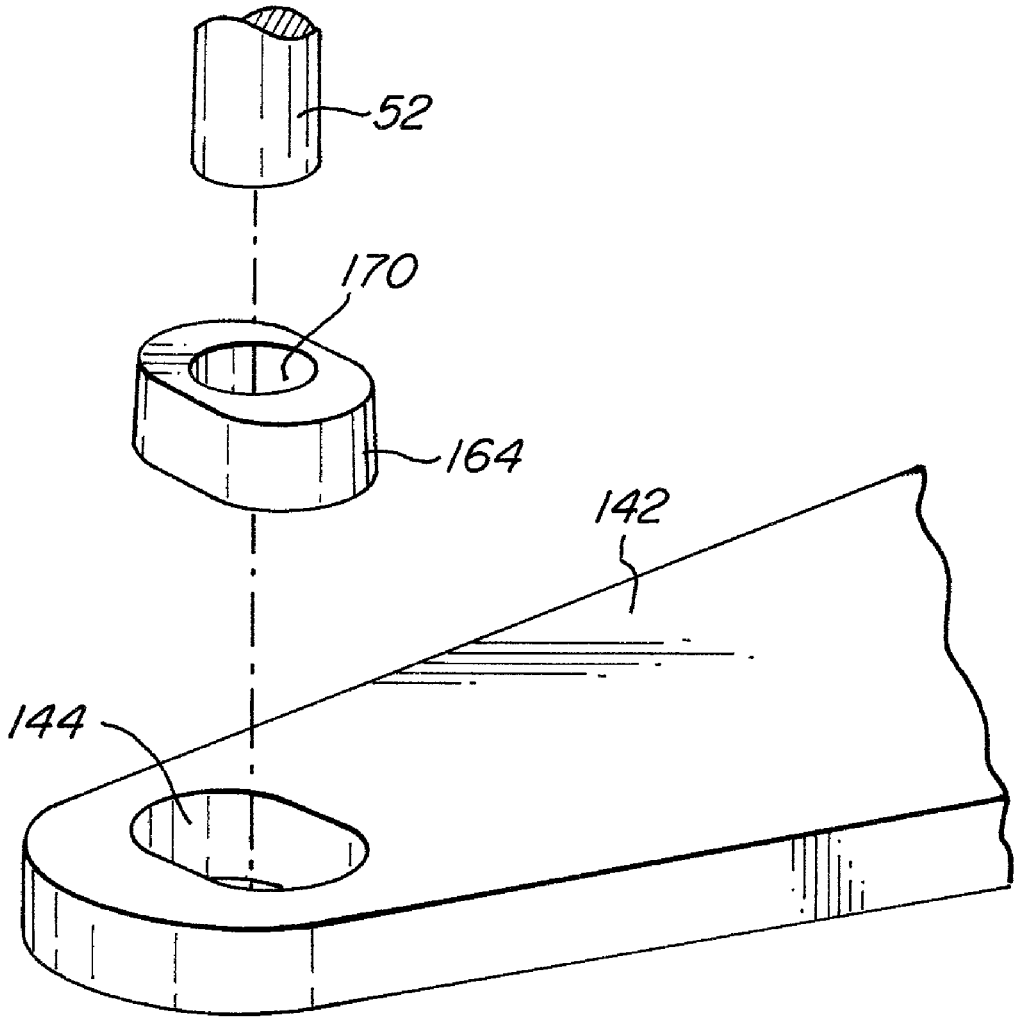
FIG. 8 is a detail view (B) of a portion of the bracket shown in FIG. 7.

FIGS. 7 and 8 illustrate a rigger or rigging system for a rowing boat 10 according to a second exemplary embodiment of the present invention. In the exemplary embodiment, the rigging system uses only one pitch adjuster (e.g., an off-center pitch adjuster 162 or a centered pitch adjuster 164) on either the top or the bottom of the bracket 140 (e.g., the top 142). As in the other embodiments disclosed herein, the bracket 140 is adapted to be attached to an outboard end portion 30 of a stay 20. One of the rigid support members 146 includes a circular hole 147. The other rigid support member 142 is equivalent to rigid support member 42 in that it accommodates a pitch adjuster 162/164. Pitch adjuster 164 is equivalent to a pitch adjuster 64.

A bolt 52 passes through the circular hole 147 in the rigid support member 146. The bolt 52 is threaded into the pin 50. On the end with the pitch adjuster 164, the bolt 52 passes through the hole 170 in the pitch adjuster 164. Hole 170 and pitch adjuster 164 are equivalent to hole 70 and pitch adjuster 64 respectively. Pitch adjusters 164 and 62 are interchangeable depending on the desired pin axis. In the case of this second embodiment, the pin axis is defined as the line passing through the centers of holes 147 and 170. The rigid support axis in this case is defined as the line passing through the centers of holes 147 and 144. FIG. 8 illustrates a detail view (B) of a portion of the rigging system shown in FIG. 7. See FIG. 8 for a more detailed view of items 164, 170, and 144.

Figure 9:
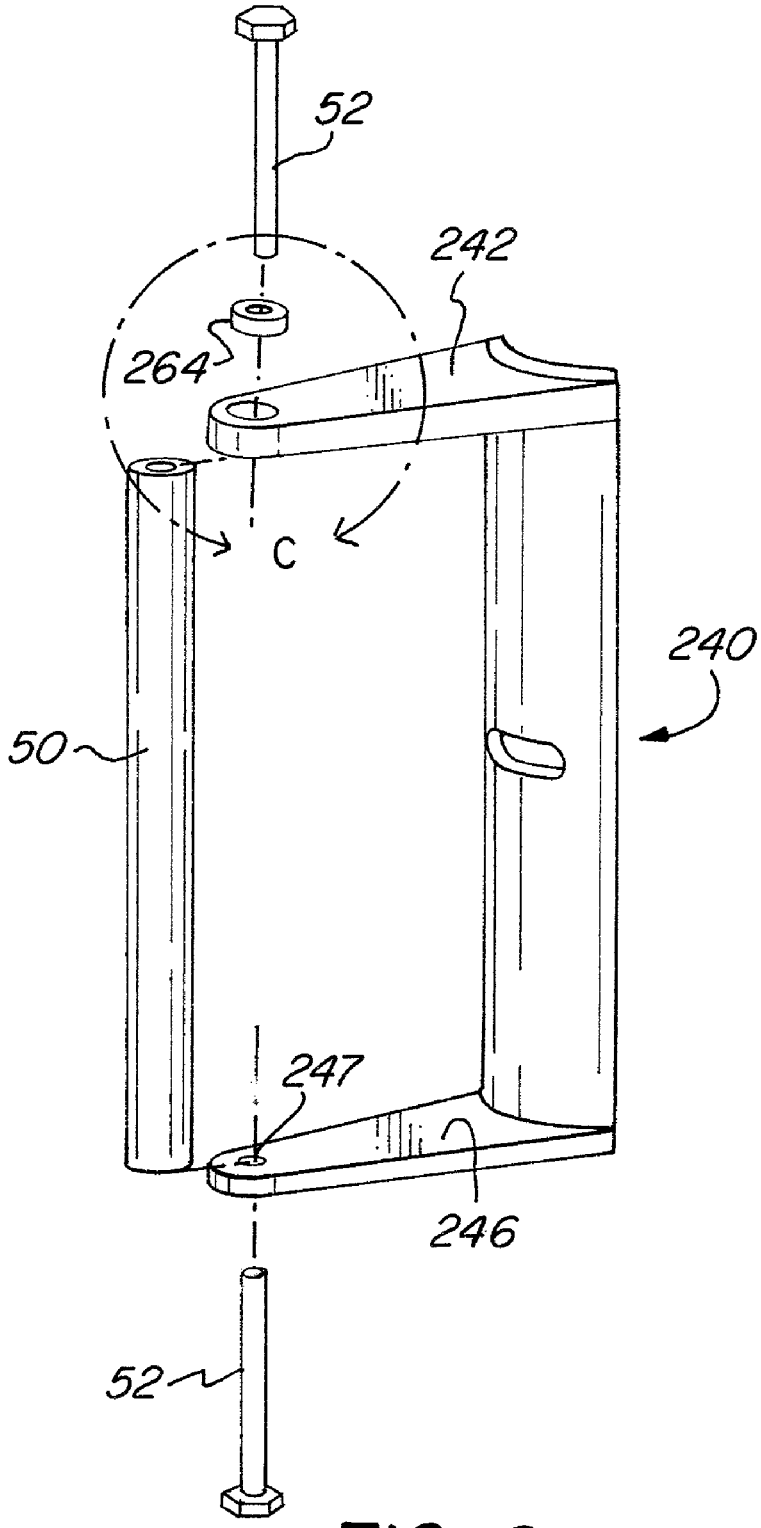
FIG. 9 is an exploded isometric view of a bracket of a rigger according to an exemplary embodiment of the present invention including a single insert system with a cavity.
Figure 10:
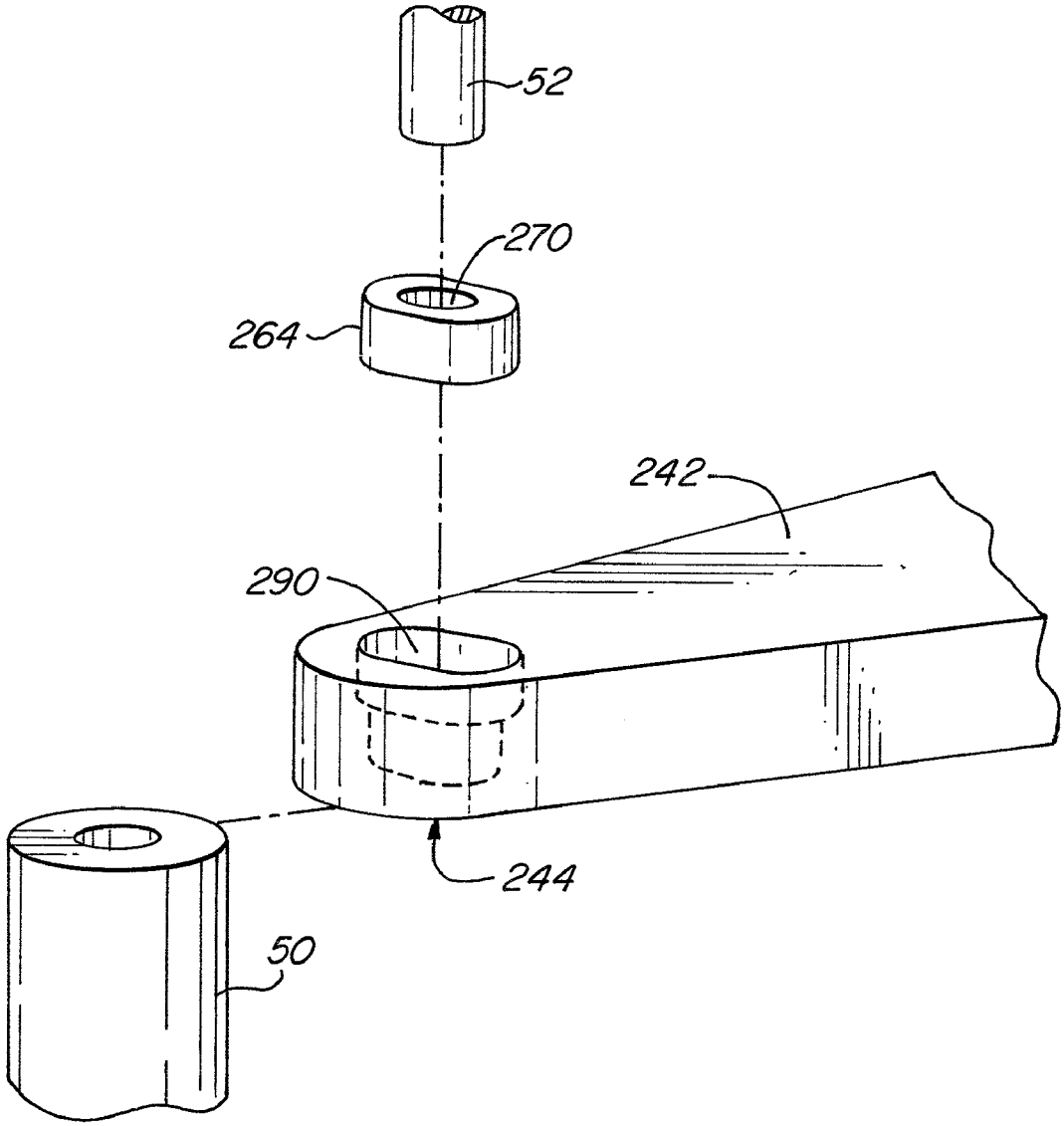
FIG. 10 is a detail view (C) of a portion of the bracket shown in FIG. 9.
Figure 11:
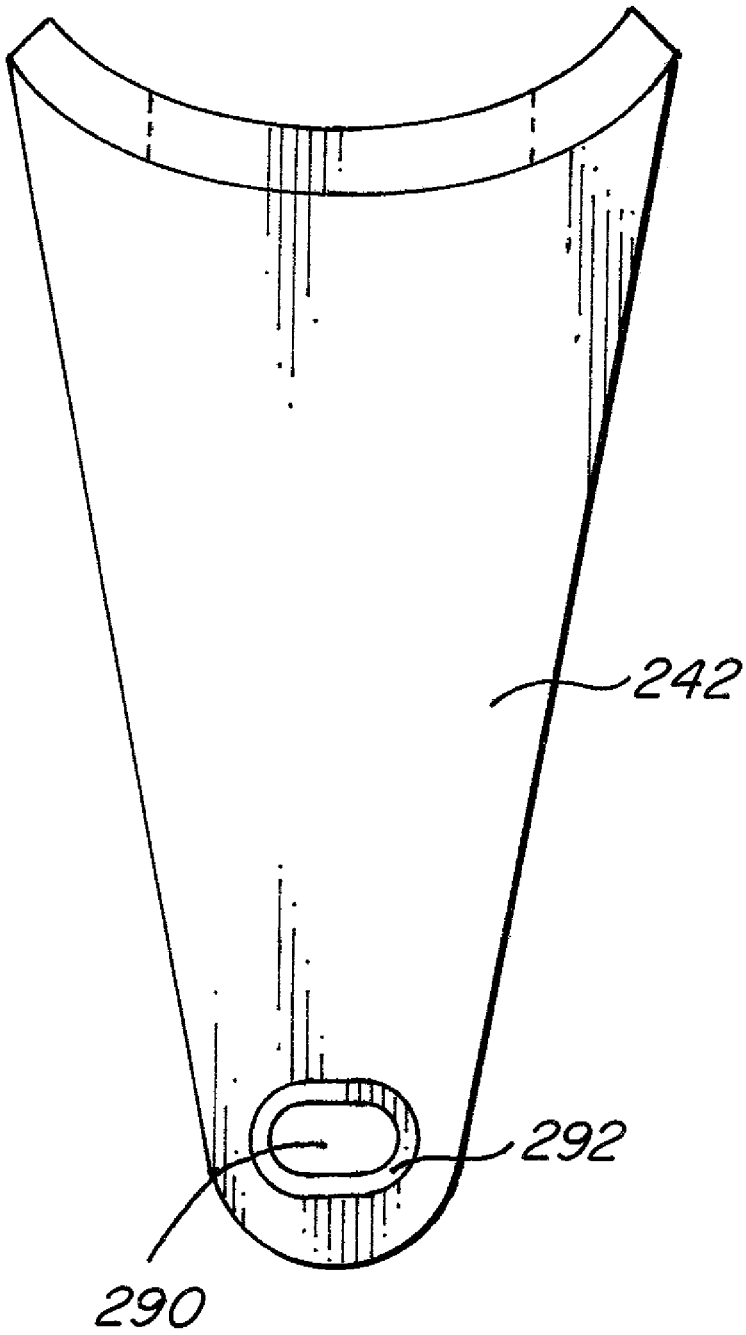
FIG. 11 is a top view of the bracket shown in FIG. 9.
Figure 12:
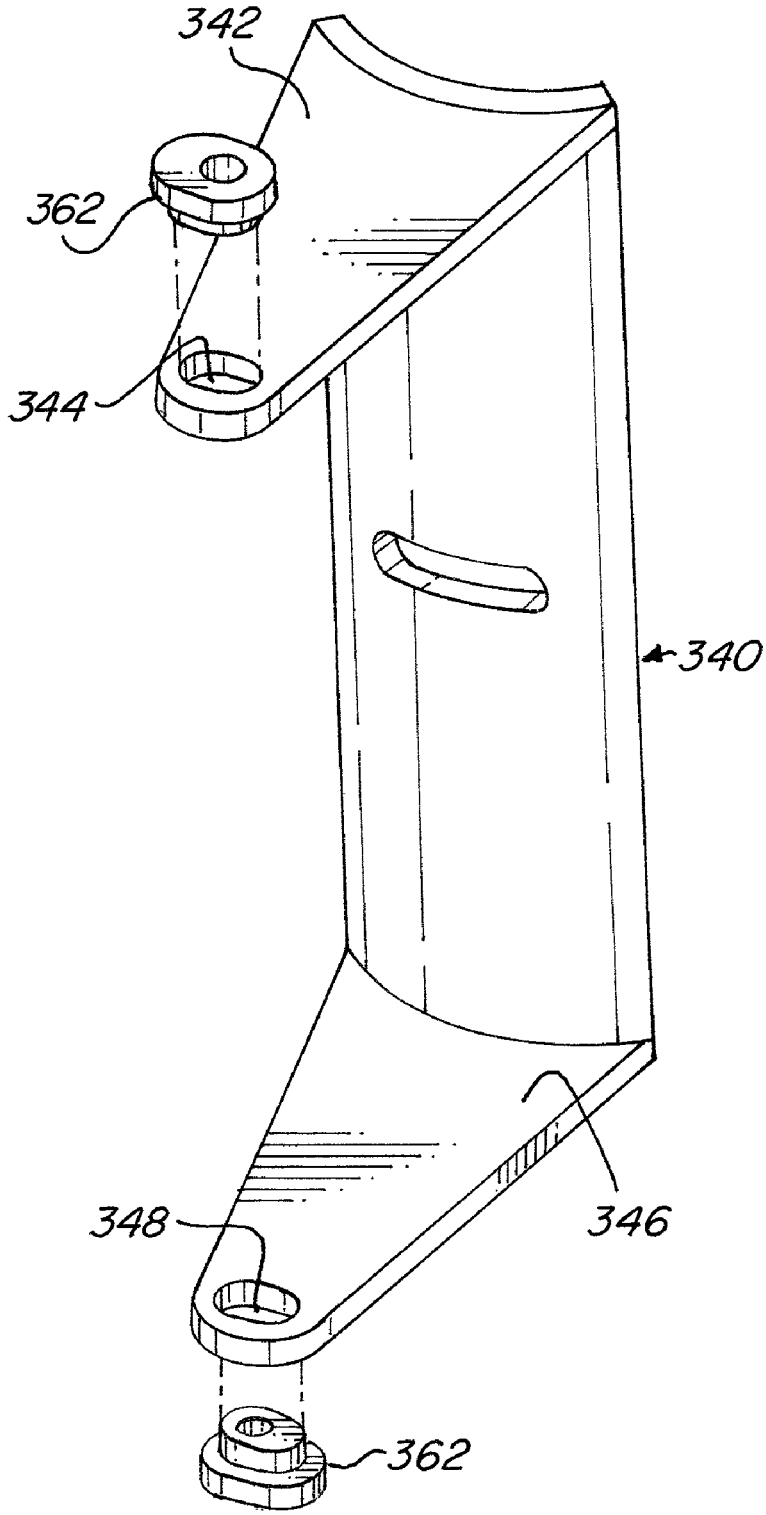
FIG. 12 is an exploded isometric view of a bracket using a two insert system including inserts having a flange.
Figure 13:
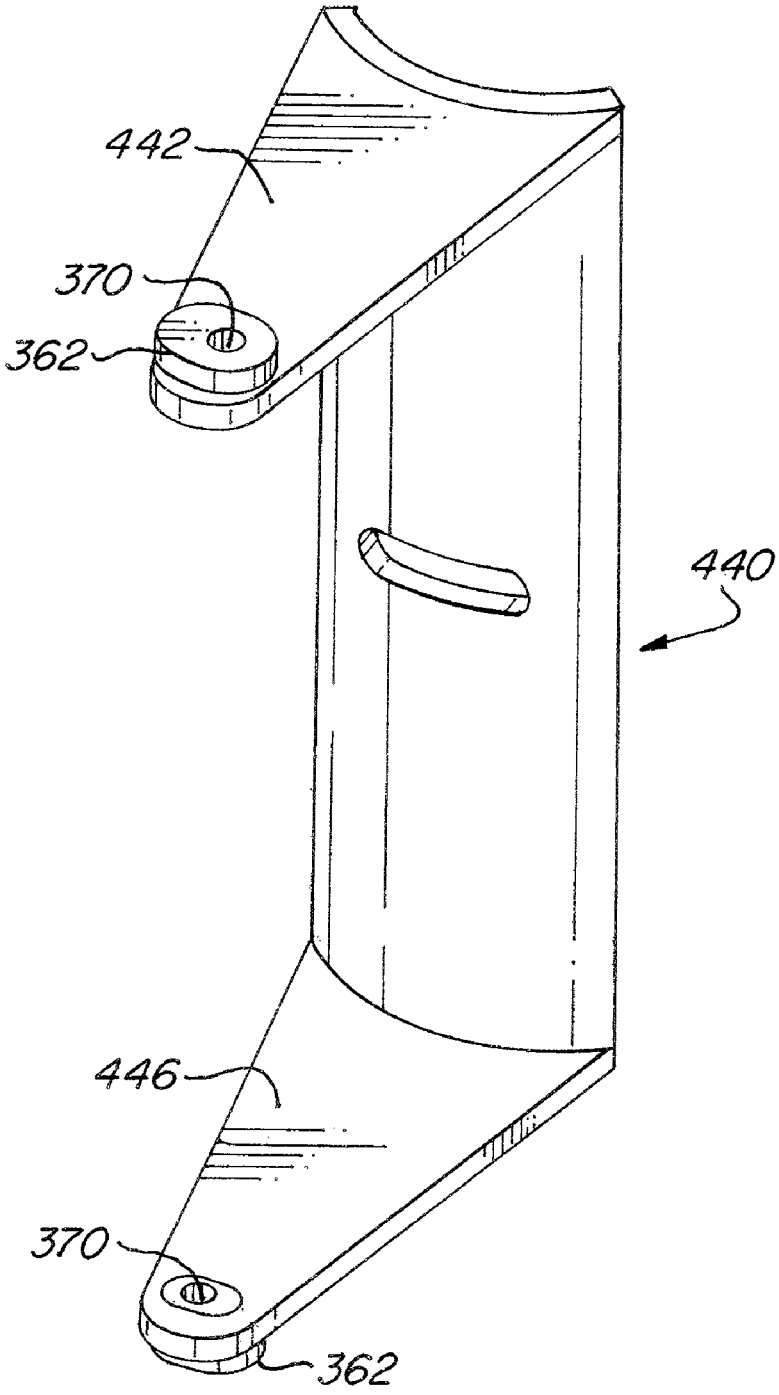
FIG. 13 is an unexploded view of FIG. 12.
Figure 14A:
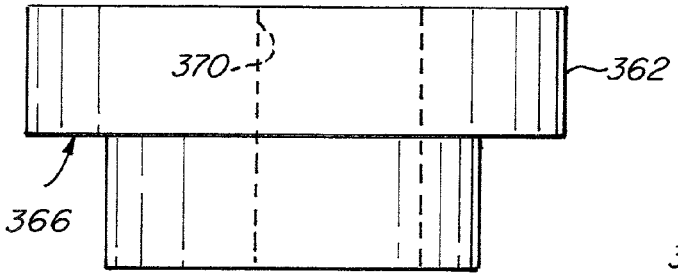
FIG. 14A is a left side view of an insert of the bracket shown in FIGS. 12 and 13 including an off-center hole.
Figure 14B:
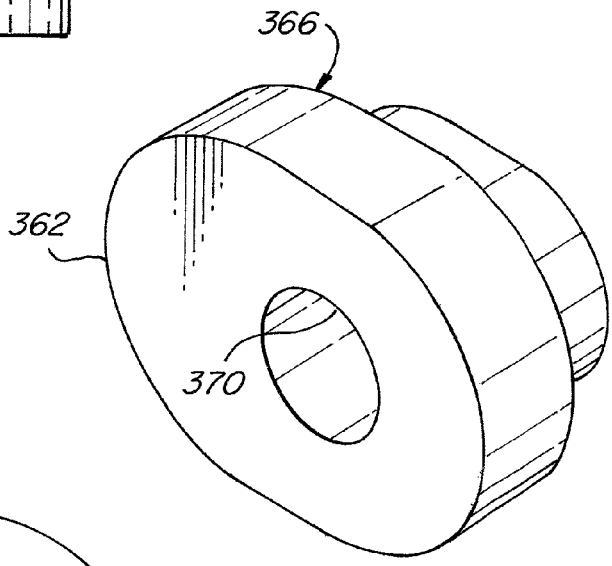
FIG. 14B is an isometric view of the insert shown in FIG. 14A.
Figure 14C:
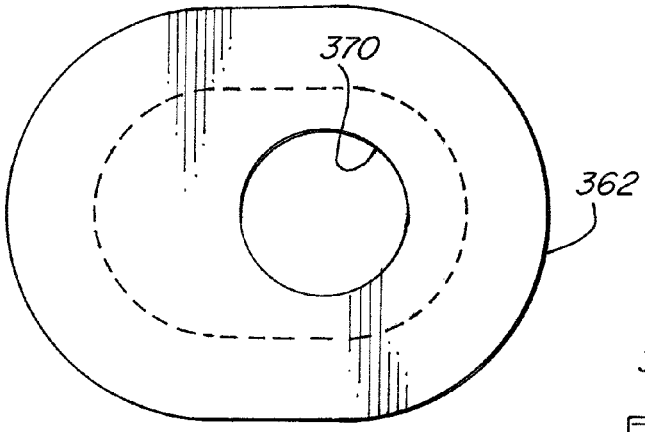
FIG. 14C is a top view of the insert shown in FIG. 14A.
Figure 14D:
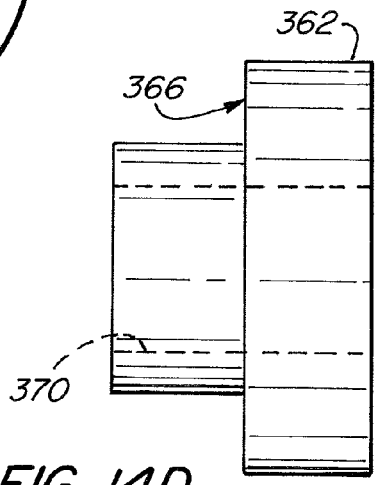
FIG. 14D is a right side view of the insert shown in FIG. 14A.

FIGS. 9-11 illustrate a rigger or rigging system according to a third exemplary embodiment of the present invention. The third embodiment is substantially equivalent to the second embodiment except that rigid support member 142 is replaced by rigid support member 242. The difference between rigid support members 142 and 242 is that a cavity 290 is created in rigid support member 242. The cavity 290 is made so the pitch adjuster 260 can be inserted into the cavity 290, against a lip 292, but not all the way through the hole 244 in the rigid support member 242.

In this exemplary embodiment, a portion of the pitch adjuster is larger than the support hole 244 in the rigid support member 242. When the pitch adjuster comes into contact with the cavity 290, it is therefore restrained in at least one direction, and the hole 270 in the pitch adjuster aligns with a portion of the hole 244 in the rigid support member 242. Preferably, the cavity restrains the pitch adjuster in at least four directions, and the cavity is essentially the female imprint of the pitch adjuster. The pitch adjuster may still be pulled out of the cavity so that a different pitch adjuster can be selected.

FIGS. 12-15 illustrate a rigger or rigging system according to a fourth exemplary embodiment of the present invention. The pin 50 and bolts 52 are not shown as they would be redundant and are shown in other drawings. The fourth embodiment is substantially equivalent to the first embodiment except that the pitch adjusters 60 are replaced with pitch adjusters 362/364. Pitch adjuster 362 is substantially equivalent to pitch adjuster 62 (shown in FIGS. 4A-4B) in that there is a hole 370 that is off-center, however there is a flange 366 on pitch adjuster 362 (see, e.g., FIGS. 14A-14D). The flange 366 prevents the pitch adjuster 362 from passing all the way through the hole 344/348 in the rigid support member 342/346. The holes 344/348 and the rigid support members 342/346 are substantially equivalent to holes 44/48 and rigid support members 42/46.

Figure 15:
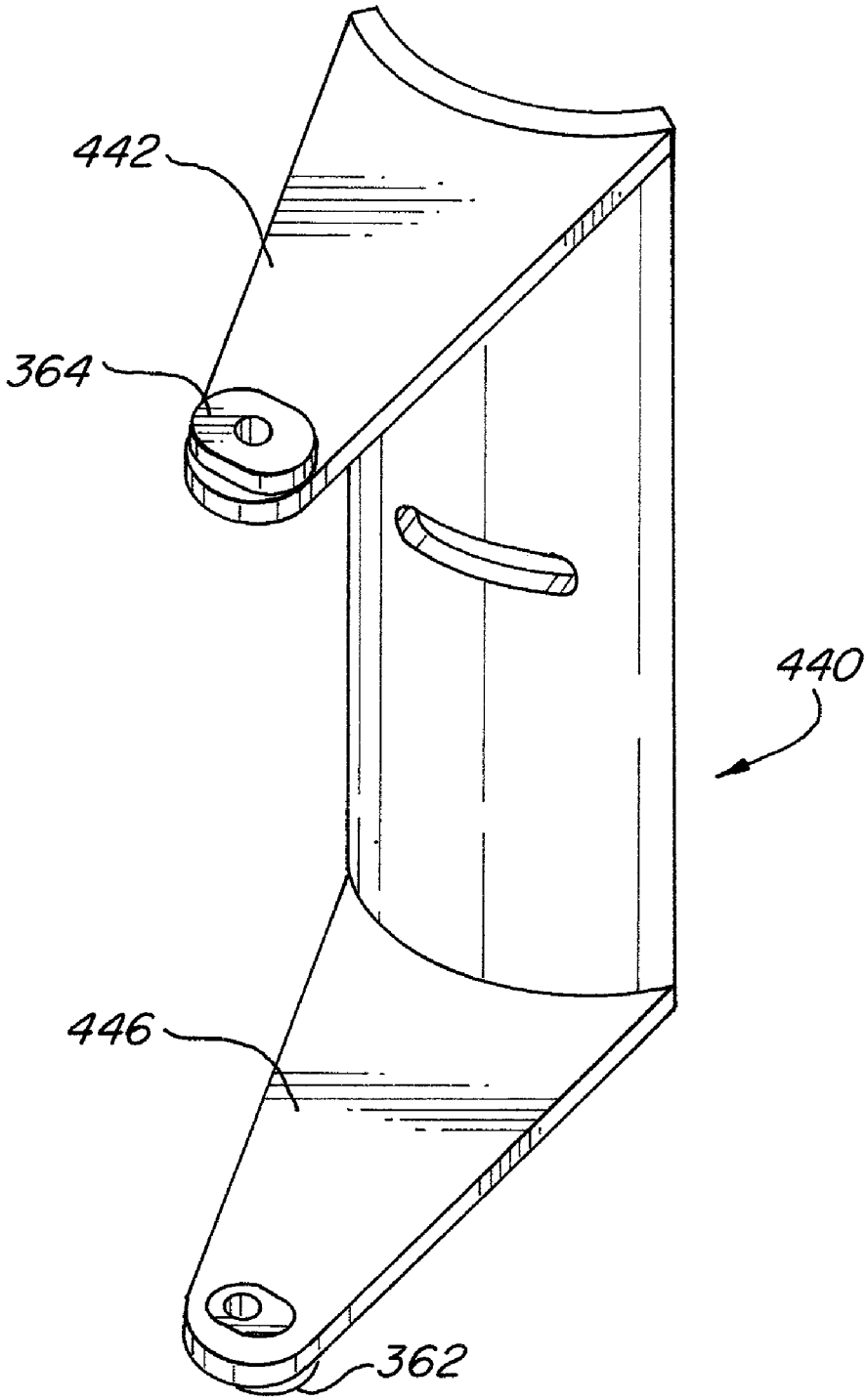
FIG. 15 is an isometric view of a bracket according to an exemplary embodiment of the present invention including one insert with off-center hole and one insert with a center hole.

Pitch adjuster 362 is interchangeable with a pitch adjuster 364 shown in FIG. 15. Pitch adjuster 364 is different from pitch adjuster 362 in that pitch adjuster 364 has a centered hole 370. The rigid support axis is defined by a line passing through the centers of the holes 344/348. The pin axis is defined as the line passing through the holes 370 depending on which pitch adjusters 362/364 are selected.

A fifth embodiment (not shown) is equivalent to the second embodiment shown in FIGS. 7 and 8 however the pitch adjuster 162 or 164 is replaced with a pitch adjuster 362 or 364, respectively, including flanges 366. Furthermore, the holes that define the pin axis are the holes 370 and 147 in this embodiment. As in the previous embodiments, the pin axis is adjustable depending on which pitch adjuster 362/364 is selected.

Figure 16A:
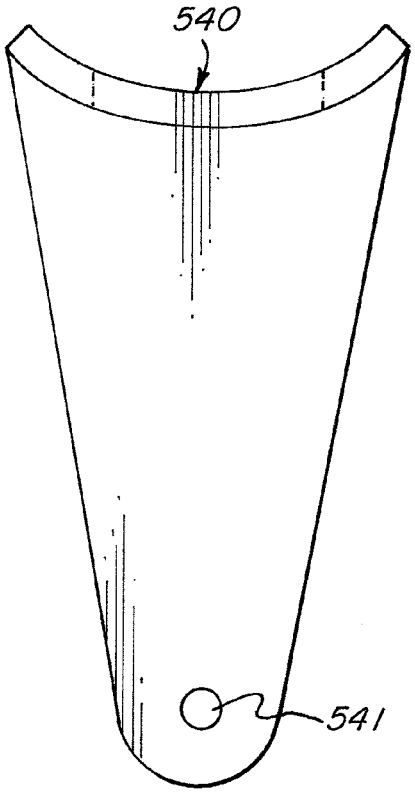
FIGS. 16A and 16B are top views of a bracket according to an exemplary embodiment of the present invention including a centered circular hole and the bracket including an off-center circular hole, respectively.
Figure 16B:
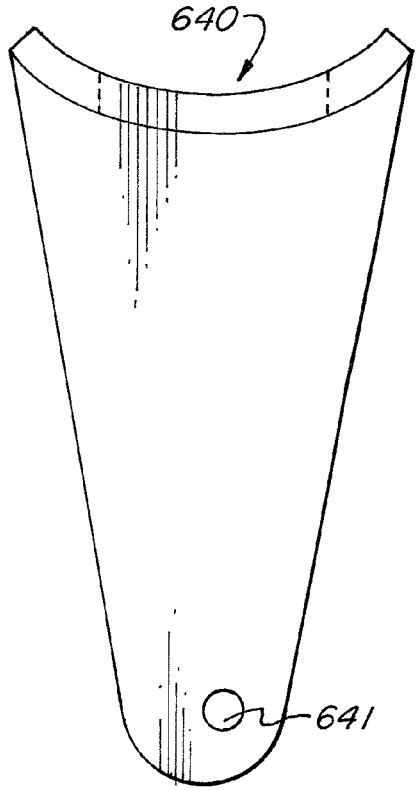

In a sixth exemplary embodiment according to the present invention, no pitch adjusters are used. Instead, the function of the pitch adjusters in the previous embodiments is performed by the location of the support holes in the rigid support member. FIGS. 16A and 16B illustrate top views of brackets 540 and 640 each including at least one hole 541/641 (e.g., support hole and pitch hole). Hole 541 is centered and hole 641 is off-center. The pin axis and the rigid support axis in this case are co-linear. The pin axis in bracket 540 is defined on one end by the centers of the holes 541 in the rigid support member. By selecting a different bracket 540/640, a different pin axis can be selected and thus the pitch of the pin may be changed.

Although the invention has been described with reference to a particular arrangement of parts, features and the like, these are not intended to exhaust all possible arrangements or features, and indeed many modifications and variations will be ascertainable to those of skill in the art.

What is claimed is:

1. An adjustable rigging system for a boat, comprising:

a bracket adapted to connect to an outboard end portion of a stay mechanism for a boat, said bracket comprising a top hole and a bottom hole, wherein an axis is defined between a center of the top hole and a center of the bottom hole;

at least one pitch adjuster removably connected to said bracket and including one of the top hole and the bottom hole;

a pin extending along said axis including two ends, each end removably connected to said bracket adjacent to one of the top and bottom holes; and wherein a location of at least one of the top and the bottom holes is adjustable to change a pitch of said axis and said pin.

2. The system according to claim 1, wherein the hole in the pitch adjuster is off-set with respect to a center of the pitch adjuster.

3. An adjustable rigging system for a boat, comprising:

a bracket adapted to connect to an outboard end portion of a stay mechanism for a boat, said bracket comprising a top hole and a bottom hole, wherein an axis is defined between a center of the to hole and a center of the bottom hole;

a pin extending along said axis including two ends, each end removably connected to said bracket adjacent to one of the top and bottom holes;

wherein a location of at least one of the top and the bottom holes is adjustable to change a pitch of said axis and said pin;

wherein said bracket further comprises a top pitch adjuster removably connected to said bracket and including the top hole and a bottom pitch adjuster removably connected to said bracket and including the bottom hole; and wherein at least one of the top and bottom holes is off-center with respect to a center of the respective pitch adjuster.

4. An adjustable rigging system for a boat, comprising:

a bracket adapted to connect to an outboard end portion of a stay mechanism for a boat, said bracket comprising a top support member and a bottom support member, each support member including a support hole;

one or more pitch adjusters each including a pitch hole, wherein at least a first one of said pitch adjusters is at least partially inserted in one of said support holes;

a pin removably connected between the top support member and the bottom support member;

wherein a center of said support hole in the top support member and a center of said support hole in the bottom support member define a support axis; and wherein a center of the pitch hole of the first one of said pitch adjusters is along a pitch axis.

5. The system according to claim 4, wherein the pitch axis is adjustable with respect to the support axis according to a selection of said one or more pitch adjusters.

6. The system according to claim 4, wherein the location of the center of the pitch hole of the first one of said pitch adjusters is adjustable to vary a pitch of the pitch axis with respect to the support axis.

7. The system according to claim 4, wherein the center of the pitch hole of the first one of said pitch adjusters is offset from the support axis.

8. The system according to claim 4, wherein the pitch hole in the first one of said pitch adjuster aligns with at least a portion of the one of the support holes.

9. The system according to claim 4, further comprising:

a second one of said pitch adjusters at least partially inserted in another one of the support holes, wherein a center of the pitch hole of the second one of said pitch adjusters is offset from the support axis.

10. The system according to claim 4, further comprising:

a second one of said pitch adjusters at least partially inserted in another one of the support holes, wherein a center of the pitch hole of the second one of said pitch adjusters is along the support axis.

11. The system according to claim 4, further comprising:

a second one of said pitch adjusters at least partially inserted in another one of the support holes; and wherein the pitch hole in the first one of said pitch adjusters and the pitch hole in the second one of said pitch adjusters define the pitch axis, the pitch axis being different from the support axis.

12. The rigger according to claim 11, further comprising;

at least a third one of said pitch adjusters, the third pitch adjuster including a pitch hole for defining another pitch axis;

wherein the third pitch adjuster is selectively interchangeable with the first and second pitch adjusters.

13. The system according to claim 4, wherein the support axis is non-parallel with respect to a pitch axis extending longitudinally through a center of the pin.

14. The system according to claim 4, wherein the center of the pitch hole of the first one of said pitch adjusters and a center of a second one of the supports holes define a pitch axis, the pitch axis being different from the support axis.

15. The system according to claim 4, further comprising;

a bolt extending through the support hole in each of the top and bottom support members and into said pin.

16. The system according to claim 4, further comprising;

a cavity around at least one of the top and bottom hole;

at least one of said pitch adjusters inserted at least partially within said cavity, wherein said cavity retains said pitch member and prevents said pitch member from passing through the at least one hole.

17. The rigging system according to claim 4, wherein at least one of said pitch adjusters includes a flange;

wherein the flange is larger than the support holes and prevents the entire pitch adjuster from passing through the support hole.

18. A rigging system for a boat, comprising:

a stay mechanism for spacing at least one pin at a predetermined distance from the boat, said stay mechanism including one or more outboard end portions;

a first bracket comprising top and bottom rigid support members spaced apart from each other by a first distance, each of said top and bottom rigid support members of said first bracket including a first hole, said first holes in said first bracket defining a first axis;

a second bracket, comprising top and bottom rigid support members spaced apart from each other by a second distance, each of said top and bottom rigid support members of said second bracket including a second hole, said second holes in said second bracket defining a second axis;

wherein said first and second holes are located in said first and second brackets, respectively, such that said first axis is at a different angle than said second axis;

wherein a selected one of the first and second brackets is releasably secured to at least one of the outboard end portions; and wherein a pin is secured to the selected one of the first and second brackets along the first or second axis of the selected one of the first and second brackets.

19. The system according to claim 18, wherein at least one of the top and bottom rigid members of the selected one of the first and second bracket includes a pitch adjuster, wherein the pitch adjuster includes the first or second hole.

20. The system according to claim 4, wherein the center of the pitch hole of said first one of said pitch adjusters is offset with respect to a center of said first one of said pitch adjusters.

* * * * *